United States Patent [19]

Moody

[11] Patent Number: 5,003,909

[45] Date of Patent: Apr. 2, 1991

[54] SUBMARINE TORPEDO TUBE COLLAPSIBLE CHOKE

[75] Inventor: Paul E. Moody, Barrington, R.I.

[73] Assignee: The United States of America as represented by the Secretary of the Navy, Washington, D.C.

[21] Appl. No.: 542,627

[22] Filed: Jun. 18, 1990

[51] Int. Cl.[5] ..... B63G 8/28; F41F 3/10

[52] U.S. Cl. ..... 114/238; 89/1.810; 114/319

[58] Field of Search ..... 114/20.1, 238, 316, 114/318, 319; 89/1.809, 1.810

[56] References Cited

U.S. PATENT DOCUMENTS

| | | | |
|---|---|---|---|
| 3,180,222 | 4/1965 | Moy | 114/238 |
| 3,364,896 | 1/1968 | Hedenberg | 114/238 |
| 3,516,380 | 6/1970 | Johnston | 114/238 |
| 3,857,321 | 12/1974 | Cohen | 114/238 |
| 4,523,538 | 6/1985 | Hollmann et al. | 114/238 |
| 4,854,260 | 8/1989 | Woidich et al. | 114/316 |

*Primary Examiner*—David H. Brown

*Attorney, Agent, or Firm*—Prithvi C. Lall; Michael J. McGowan

[57] ABSTRACT

A bimodal flow restriction device having an open condition and a closed condition is disclosed. In its open condition, an annular fluid flow path defined between a torpedo enclosed within a larger torpedo tube is open to support a torpedo launch in a swim-out mode. In order to facilitate a swim-out launch, water must flow from the forward portion of the torpedo, along its body and into its propeller. In its closed condition, the annular fluid flow path defined between the torpedo enclosed within the larger torpedo tube is closed-off to enable torpedo launch in a pump-ejection mode. In the preferred embodiment, plural, cooperative elbows are disposed about an inside circumference of the torpedo tube, and are radially movable between a closed condition, where they provide an annular impediment in the annular fluid flow path to enable operation in the pump-ejection mode, and an open condition, where the annular fluid flow path is open, to enable operation in the swim-out mode. Each of the radially-movable cooperative elbows is preferably keystone-shaped, and includes rubber or other elastomeric bumper members to provide low-noise operation.

12 Claims, 2 Drawing Sheets

SUBMARINE TORPEDO TUBE COLLAPSIBLE CHOKE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1.) Field of the Invention

The instant invention is directed to the field of flow restriction devices, and more particularly, to a bimodal flow restriction device for torpedo tubes.

(2.) Description of the Prior Art

Conventional torpedo tubes have longitudinal lands which run the length of the torpedo tubes and circular lands which are normally located at the tube section-intersect points and on both the breech and muzzle ends of the torpedo tubes. The lands support the torpedoes as well as equipment associated with torpedo launch and other controllers and ancillary equipment.

To eject a torpedo, a pump directs a high pressure plume of water behind the weapon. The pressure unbalance between the tail and nose of the weapon results in a force unbalance, which ejects the weapon. In some torpedo tubes, the diameters of the tubes are larger than the diameters of the torpedoes, and annular fluid flow paths around the weapons are thereby created. A great deal 3 of the pump's energy is expended in ejecting the annulus of water in lieu of the weapon. This severely reduces the efficiency associated with ejecting the weapon.

SUMMARY OF THE INVENTION

In accord with its principal object, the present invention discloses a bimodal flow restriction device having an open condition and a closed condition. In its open condition, the annular fluid flow path defined between a torpedo enclosed within a larger torpedo tube is open to support a torpedo launch in a swim-out mode. In order to facilitate a swim-out launch, water must flow from the forward portion of the torpedo, along its body and into its propeller. In its closed condition, the annular fluid flow path defined between the torpedo enclosed within the larger torpedo tube is closed-off to enable torpedo launch in a pump-ejection mode. In the preferred embodiment, plural, cooperative elbows are disposed about an inside circumference of a torpedo tube, and are radially movable between a closed condition, where they provide an annular impediment in the annular fluid flow path to enable operation in the pump-ejection mode, and an open condition, where the annular fluid flow path is open, to enable operation in the swim-out mode. Each of the radially-movable cooperative elbows is preferably keystoneshaped, and includes rubber or other elastomeric bumper members to provide low-noise operation.

BRIEF DESCRIPTION OF THE DRAWINGS

These and other objects, advantages and features of the present invention will become apparent as the invention becomes better understood by referring to the following detailed description of the preferred embodiments thereof, and to the drawings, wherein.

DETAILED DESCRIPTION OF THE PREFERRED EMBODIMENTS

Figure 1:
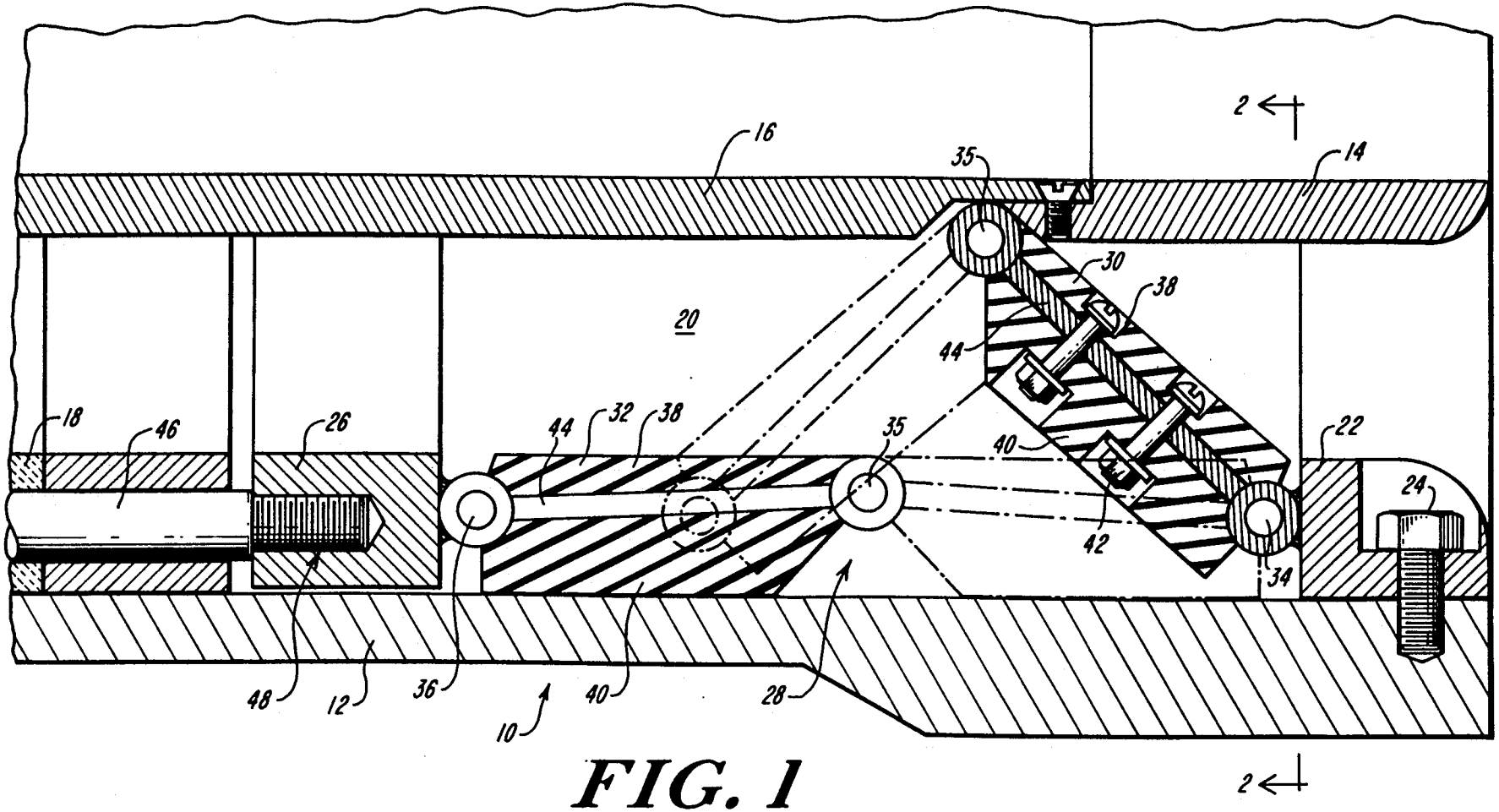
FIG. 1 is a fragmentary longitudinal section of a muzzle end of a torpedo tube showing the novel bimodal flow restriction device of the present invention.
Figure 2:
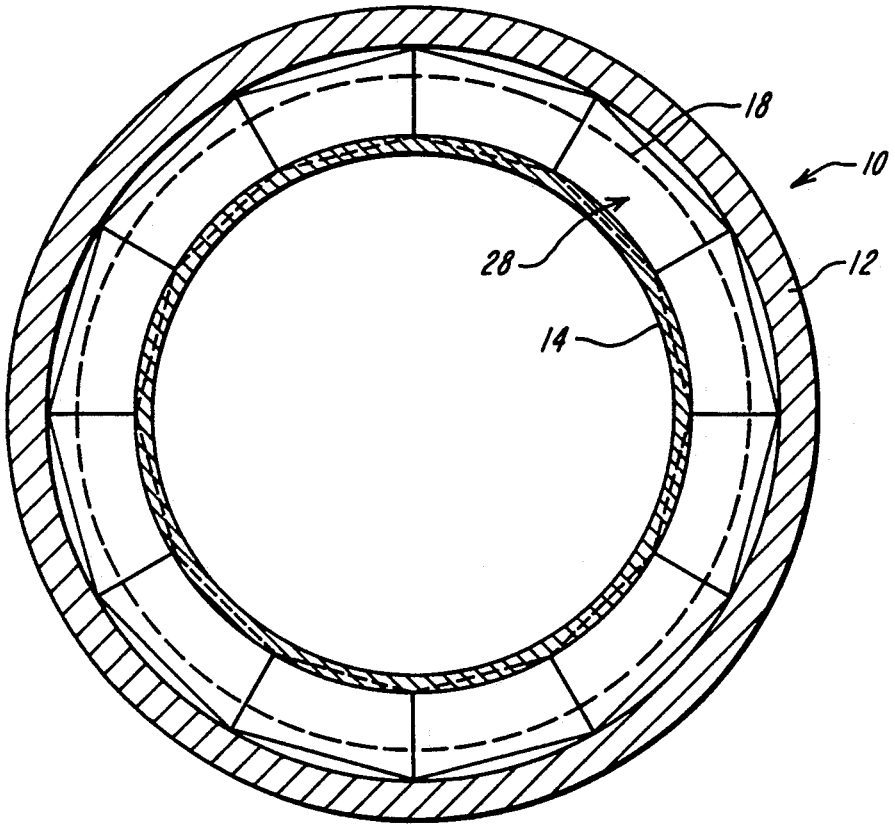
FIG. 2 is a circumferentially rolled-out sectional view along the lines 2—2 of FIG. 1.

Referring now to FIGS. 1 and 2, generally designated at 10 is the novel bimodal flow restriction device for torpedo tubes according to the present invention. Into a torpedo tube 12, circular lands 14 are supported adjacent the muzzle end and breech end thereof and four longitudinal lands 16 are supported longitudinally therewithin, in a manner well known to those skilled in the art. The lands 14, and 16 receive the torpedo, and provide mounts for ancillary equipment. An annular acoustic liner 18 may be provided on the inside circumferential wall of the torpedo tube 12 to absorb noise during launch of a torpedo in either a swim-out or a pump-ejection mode. Between the acoustic liner 18 and the circular lands 14, an annular fluid flow passageway generally designated 20 is defined.

A muzzle ring 22 is fastened as by bolts 24 to the muzzle end of the torpedo tube 12. An annular, longitudinally-movable drive ring 26 is mounted inside the torpedo tube 12 in spaced-apart relation to the muzzle ring 22. Between the circular drive ring 26 and the muzzle ring 22 a plurality of cooperative, radially-movable, elbow assemblies generally designated 28 are circumferentially mounted in angularly spaced-apart relation.

Each elbow assembly 28 includes an arm member 30 and a forearm member 32. The arm member 30 of each of which is pivotally attached as by a linear hinge 34 to a different angularly offset portion of the muzzle ring 22, and is pivotally attached as by a linear pivot 35 to one end of the corresponding forearm member 32. The other end of the forearm member 32 of each elbow assembly 28 is pivotally attached to a different annularly offset portion of the annular drive ring 26 as by a linear pivot 36. The hinges 35 of each of the elbow assemblies 28 between their respective arms and forearms are located radially inwardly of the center line between the hinges 34, 36 in their open condition, such that the elbows each move radially inwardly in response to longitudinal motion to be described of the annular drive ring 26.

As shown in FIG. 2, the arm member 30 and the forearm member 32 of each of the elbow assemblies 28 is preferably keystoneshaped, although other shapes can be employed as well without departing from the inventive concept.

The arm member 30 and the forearm member 32 of each of the elbow assemblies 28 is preferably constituted as a sandwich of outer elastomeric layers 38, 40, which layers 38, 40 are fastened by any suitable means, as by bolts 42, to an inner strength imparting plate 44, while plate 44 is mechanically joined to their respective terminal hinges. The layers 38, 40 preferably are rubber, and the plate 44 preferably is a metal.

One or more power shafts 46, preferably four uniformly circumferentially spaced shafts, are slidably received in annular bores generally designated 48 provided therefor in the annular drive ring 26. The power shafts 46 are connected to any suitable linear actuator, such as an actuator separately provided therefor, or to an actuator mechanism associated with slide valves typically found on torpedo tubes.

In operation, the elbows 28 in their open condition substantially line and lie along the inner circumferential wall of the torpedo tube 12 in a position where they are free of the annular fluid flow path 20. With the elbows in their open conditions, the annular fluid flow path 20 is allowed to be flooded with water so that the corresponding torpedo is enabled to be launched in a swim-out mode. To move the elbows to their closed condition, the linear actuator moves the power shafts 46 fastened to the annular drive ring 26 towards the muzzle end of the torpedo tube 12. With the continued stroke of the power shafts, the elbows 28 radially collapse inwardly, and at the end of their stroke, the elbow assemblies are snug against the circular land 14, and the arm members 30 and forearm members 32 of each of the elbow assemblies 28 bump snugly against each other. In the closed condition of the elbows 28 as best seen in FIG. 2, the lateral edges of the elbows abut each other at radial interfaces and cooperate to provide a circumferential wall which extends into and impedes the annular fluid flow path 20. With the elbows 28 in their closed condition, high-pressure water that is forced into the breech end of the torpedo tube substantially acts against the aft end of the corresponding torpedo providing efficient launch of the same in the pump eject mode. The power shafts fastened to the annular drive ring are moved longitudinally towards the breech end of the torpedo tube to cause the elbow assemblies to assure their open conditions.

In the preferred embodiment, twelve elbow assemblies are employed, although a different number could be employed as well without departing form the inventive concept. Other shapes than a keystone shape could be employed as well. The elbow assemblies could be attached to the torpedo tube by a mechanical system. The entire interior circumferential wall of the torpedo tube could be epoxied flush for smooth flow purposes.

Other modifications of the present invention will readily become apparent to those skilled in the art without departing from the inventive concept.

What is claimed is:

1. A bimodal flow restriction device enabling to provide in one mode pump-ejection and in another mode swim-out of a torpedo in a torpedo tube of larger diameter than that of the torpedo defining thereby an annular fluid flow path between the torpedo tube and the torpedo, comprising:

means mounted in the torpedo tube for providing a mechanical impediment movable between an open state where the mechanical impediment is free of the annular fluid flow path and a closed state where the mechanical impediment impedes the annular flow path; and means for selectively moving the mechanical impediment between its open and its closed state.

2. The invention of claim 1, wherein said mechanical impediment providing means includes elastomeric members.

3. The invention of claim 1, wherein said mechanical impediment is constituted as a plurality of plural segments each mounted to a different angularly offset location about a circumference of the torpedo tube that are individually movable between an open state where each segment lies flush with the torpedo tube and a closed state where each segment projects radially inwardly towards the center of the torpedo tube and that together cooperate in their closed state to provide said mechanical impediment.

4. The invention of claim 3, wherein said segments are keystone-shaped.

5. The invention of claim 3, wherein said segments are elbow assemblies each having an arm member pivotally connected to a forearm member.

6. The invention of claim 5, wherein said moving means includes means for causing said elbow assemblies to pivotally extend and retract in such manner that when extended they lie in their open state and when contracted they lie in their closed state.

7. A bimodal flow restriction device enabling to provide in one mode pump-ejection and in another mode swim-out of a torpedo in a torpedo tube having an inside circumferential wall of larger diameter than that of the torpedo defining thereby an annular fluid flow path between the torpedo and the inside circumferential wall of the torpedo tube, comprising:

plural elbow assemblies, each including an arm pivotally attached to a forearm;

means for mounting the plural elbow assemblies to the inside circumferential wall of the torpedo tube for movement between an open condition where the arm and forearm are generally aligned about a common axis and substantially line the torpedo tube and a closed condition where the arm and forearm of each elbow assembly are angled with respect to each other and the elbows in their closed condition are cooperative to provide an annular wall that extends radially into the torpedo tube that blocks the annular fluid flow path; and means coupled to the plural elbow assemblies and cooperative with the mounting means for selectively moving the plural elbow assemblies between their open and closed conditions.

8. The invention of claims 7, wherein said arm pivotally attached to said forearm of each of said plural elbow assemblies is constituted as a sandwich of outer elastomeric layers and an inner strength imparting plate.

9. The invention of claim 8, wherein said layers are keystone shaped.

10. The invention of claim 7, wherein said mounting means includes a muzzle ring attached to the torpedo tube to which the arm of each of the plural elbow assemblies is pivotally attached, an annular drive ring spaced from the muzzle ring to which the forearm of each of the plural elbow assemblies is pivotally attached and wherein said moving means includes means for reciprocally moving the drive ring towards and away from the muzzle ring.

11. The invention of claim 10, wherein each of the arms pivotally attached to the forearms of each of the plural elbow assemblies are so biased that each of the elbow assemblies favors a motion radially inwardly of the torpedo tube as the elbow assemblies are moved from their open to their closed conditions.

12. The invention of claim 10, wherein said reciprocally moving means includes at least one power shaft connected to the annular drive ring.

* * * * *